United States Patent [19]

Arjalies et al.

[11] 4,036,337

[45] July 19, 1977

[54] ONE-PIECE CONDUCTOR ROLLER FOR ELECTROLYTIC PROCESSING OF STRIP MATERIALS

[75] Inventors: Georges Arjalies, La Garde; Jean-Claude Guillais, Sartrouville, both of France

[73] Assignee: Les Traitements de Surface Nobel-Bozel, Gaillonnet-Seraincourt, France

[21] Appl. No.: 699,636

[22] Filed: June 24, 1976

[30] Foreign Application Priority Data

June 26, 1975 France ..... 75.20149

[51] Int. Cl.[2] ..... C25D 7/04

[52] U.S. Cl. ..... 191/1 A; 204/25; 204/279

[58] Field of Search ..... 191/1 A; 204/25, 279

[56] References Cited

U.S. PATENT DOCUMENTS

| | | | |
|---|---|---|---|
| 2,127,824 | 8/1938 | Leuchter | 191/1 A |
| 2,526,312 | 10/1950 | Winterhalter | 191/1 A |
| 3,887,776 | 6/1975 | Kanbayashi | 191/1 A |

*Primary Examiner*—Trygve M. Blix
*Assistant Examiner*—Reinhard J. Eisenzopf
*Attorney, Agent, or Firm*—Karl W. Flocks

[57] ABSTRACT

A roller for the continuous electrolytic processing of metallic or metallized strip materials which is a good electrical conductor is provided with a circuit for cooling fluid. It has two forged flanges each defining a hollow half shaft along a common longitudinal axis. The two flanges are made fast to the respective ends of a hollow cylindrical body. Proceding from the outer cylindrical surface of the assembly of the flanges and of the body there are provided successively radially outwards from said surface: a continuous layer of uniform thickness of a corrosion-resistant metal, a continuous layer of a metal which is a good conductor of electricity with constant cross-section for the passage of electric current, the zone of the face of the roller being also provided with an outer coating of a hard metal. The flanges may have an internal cup shape. A cooling liquid can flow through the hollow shafts.

2 Claims, 3 Drawing Figures

ONE-PIECE CONDUCTOR ROLLER FOR ELECTROLYTIC PROCESSING OF STRIP MATERIALS

BACKGROUND OF THE INVENTION

1. Field of the Invention

The present invention relates to a roller for an installation for the continuous electrolytic processing of metallic or metallised materials in strips.

2. Description of the Prior Art

In known installations for continuous electrolytic processing, the electric current necessary for the electrolytic process is tranmitted continuously to the metallic strip in the course of treatment through rollers placed above the processing tanks. The intensity of the electric current passing through the roller is very high and can reach, according to the case, 10,000 to 20,000 amperes. It is therefore necessary to have very solid rollers, which are good conductors of electricity and of heat and which have good resistance to wear and to corrosion. In addition, the heating produced in the course of the processing necessitates effective cooling by means of the circulation of water inside the rollers: the latter are therefore hollow.

Among rollers designed for this type of processing at the present time, the most customary type comprises a shaft on which two flanges, supporting an outer collar, are shrunk on. These elements are of steel and contribute a relatively good mechanical strength to the assembly. However, to enable the passage of electric current, it is necessary to attach elements of copper. For this purpose, there is added to the projecting portion of the shaft, a part provided with a sleeve and with a flange or "tulip" of copper against the steel flange of the roller. This tulip is connected electrically to the face of the roller and the current is led on to said tulips through two collectors arranged close to the ends of the shaft.

This roller construction presents however numerous drawbacks and in particular:

it necessitates multiple fastenings, hence expensive manufacture; and with time, these fastenings develop play;

the steel flanges are made fast to the central shaft by a weld and this weld constitutes a source of serious occurences on the latter, often leading to rupture;

the juxtaposition of parts against one another can leave a passage for acid or other infiltrations resulting, on the shaft, at the most sensitive and mechanically weakest point, in corrosion jeopardising also the performance of the shaft; here again, these phenomena can result in the rupture of the latter;

the arrangement of the inlet and outlet for cooling water makes complete drainage of the roller very difficult.

The above drawbacks arise directly from this construction which has the major disadvantage of not preserving the most sensitive section of the shaft situated perpendicular to the flanges.

OBJECTS AND GENERAL DESCRIPTION OF THE INVENTION

It is accordingly an object of the present invention to provide a roller which no longer includes fastening, welding on the shaft, or shrunk on and united parts.

It is therefore also an object to provide a roller which eliminates the possibilities of infiltrations and consequent rupture of the shaft.

It is a further object to provide a roller which ensures complete protection against corrosion of the outer assembly of the roller. Other objects and advantages of the roller according to the invention will become apparent on reading the description which follows.

According to the invention there is provided a one piece conductive roller for electrolytic processing which is essentially characterised by the fact that it comprises two forged flanges each defining a half-shaft along a common longitudinal axis, the two flanges being made fast to a hollow cylindrical body, the assembly of the flanges and of the body comprising successively a continuous layer of uniform thickness of a corrosion resistant metal, a continuous layer of an electrically good conducting metal with a constant cross-section for the passage of the electric current, the face of the roller being also provided with an outer coating of a hard metal.

According to another feature of the invention, the flanges have the internal shape of a cup.

In accordance with another feature the forged flanges are of steel as well as the cylindrical body, the corrosion resistant metal being nickel, the electrically good conducting metal being copper, and the hard metal being chromium.

According to another feature the two half-shafts are provided with a passage for the flow of cooling fluid for the roller.

BRIEF DESCRIPTION OF THE DRAWINGS

In order that the invention may be more fully understood, a preferred embodiment thereof is described below with reference to the accompanying drawings, given purely by way of illustrative and non-limiting example. In the drawings.

DESCRIPTION OF A PREFERRED EMBODIMENT

Figure 1:
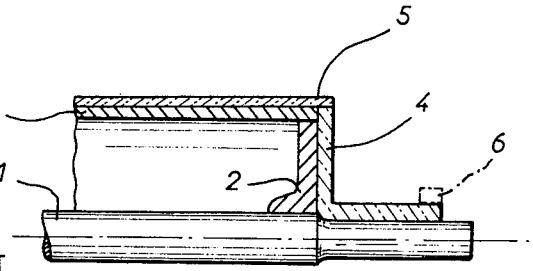
FIG.1 PRIOR ART
FIG. 1 shows a fragmentary and diagramatic view in section of a roller of known type.

Referring to FIG. 1, the roller of known type comprises a shaft 1 on which has been shrunk two flanges 2 supporting an outer sleeve 3, whilst there are attached in addition, to ensure the passage of the electric current, two "tulips" 4 connected electrically to a coating of copper 5, the electric current being led on to the sleeve of the tulip by means of the collector 6. As indicated above, this construction can lead to the breaking of the shaft, mainly due to the fact of the welding of the flange 2 on the shaft 1 and possible infiltrations between said flange and the tulip 4.

Figure 2:
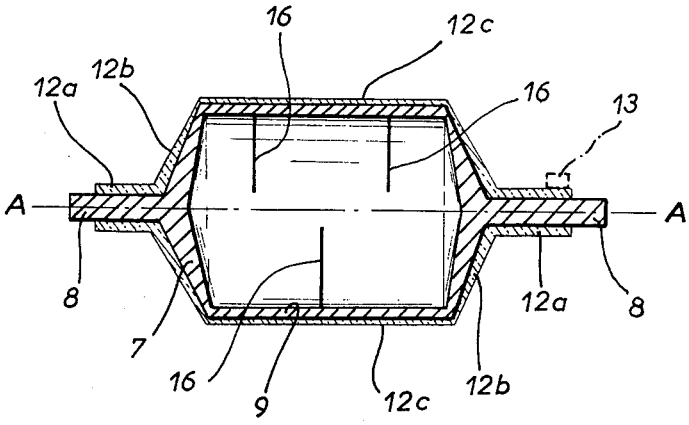
FIG. 2 shows a general diagramatic view in section of an embodiment of a roller according to the invention.
Figure 3:
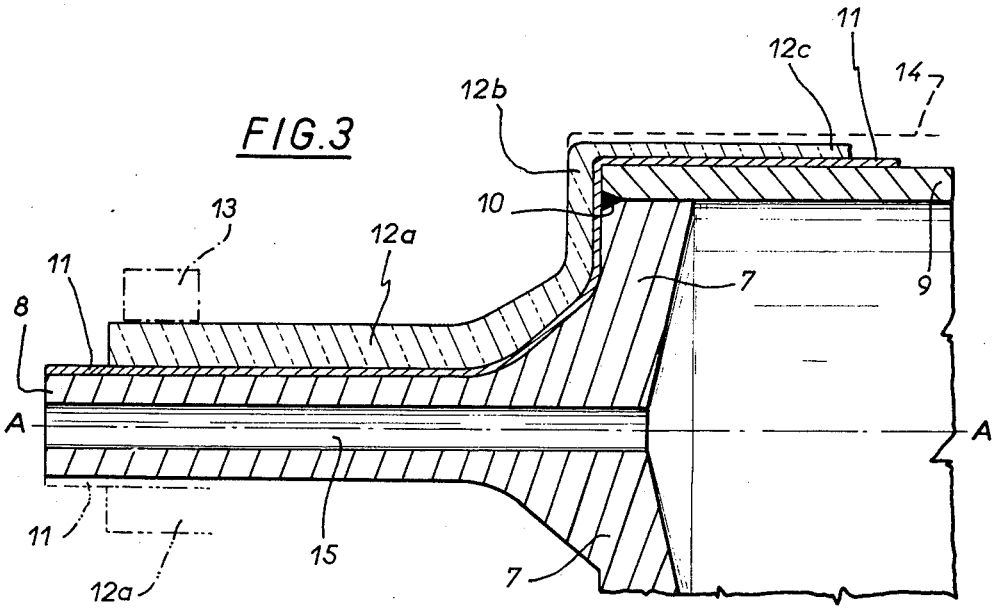
FIG. 3 shows an enlarged diagramatic view in section at the level of a flange of the embodiment shown in FIG. 2.

Referring to FIGS. 2 and 3, a roller according to the invention is constituted by two forged flanges 7, preferably internally cup-shaped enabling simple and complete drainage of the cooling fluid passing into the body of the roller. The outward extension of the flanges 7 constitutes the shaft proper 8 of longitudinal axis A—A and supported on any suitable bearing (not shown). The cross-section of the flanges, specially designed on account of the alternating bending stresses, palliates the weakest point of the known type of construction shown FIG. 1.

The flanges are fastened to the steel hollow cylindrical body 9 by means, for example, of a peripheral weld 10. The flanges and the shaft thus constituted in a single part give excellent strength taking into account the alternating forces which the roller sustains.

The flanges-body assembly is firstly protected externally against corrosion by a continuous layer of nickel 11 of uniform thickness, by means of an electrolytic process, for example, the process known as "by Fescolisation".

To permit passage of electric current, mainly 8,000 to 10,000 amperes through the collector, the roller is coated over the whole of its assembly with a continuous layer, from collector to collector, of electrolytic copper 12*a,* 12*b,* 12*c.* This particular electrolytic deposit enables variable thicknesses of copper to be obtained, responding to the essential requirements of constancy of cross-section of copper for the passage of electric current from the collectors 13. The production of this electrolytic deposit of copper can be effected in several stages and then consists of depositing successive layers to obtain suitable thicknesses. This electrolytic deposit can also be produced by varying the shape and the arrangement of the anodes, the two essential characteristics of this layer being its continuity from collector to collector and its variable thickness to obtain a constant cross-section for the passage of the current.

The face of the roller can lastly be provided with an electrolytic coating of hard chromium 14 of constant thickness. By way of purely indicative and non-limiting example, it is possible to construct a roller according to the invention, of 610 mm outer diameter, whose layer 14 has 3/10 mm thickness, the thickness of the layer 12*a* to 12*c* varies from 10 mm to 3 mm and the thickness of the layer 11 is about 5/100 mm.

The shaft 8 of the roller is itself hollow and includes a channel 15 designed for the cooling fluid, which is generally water. The inside of the roller can also be provided with any suitable baffles 16 (FIG. 2) designed in manner known in itself so as to ensure better utilisation of the cooling fluid.

The structure of the roller according to the invention hence results from the essential requirements according to which copper is necessarily present to ensure the electrical conductibility, whilst it was not possible to maintain copper flanges shrunk on to steel flanges, notably at the level of the shaft, due to the fact of the formation of electrical cells resulting in corrosion. In the same way, the fluid-tightness required cannot be obtained by juxtaposition or joining of mechanical parts, resulting in infiltrations which are also a cause of shaft rupture.

We claim:

1. A roller for the continuous electrolytic processing of metallic or metallized strip materials comprising a hollow cylindrical body, two flanges disposed along a common longitudinal axis with and fastened to the respective ends of said cylindrical body, each said flange comprising end to end along said common longitudinal axis, a cup and a half roller shaft in a single piece, each said flange being fastened to a respective end of said cylindrical body at the periphery of said cup, inner walls of said cup of said flanges disposed face to face to each other to form inner end walls of the roller, said flanges being axially transpierced by a longitudinal bore on said inner wall of said cup to convey a cooling fluid to refrigerate the roller, said body and said flanges having their outer surface covered with a continuous layer of uniform thickness of a corrosion-resistant metal and covered thereon with a continuous layer of a metal of good electrical conductivity having a constant cross section for the passage of an electric current, the zone of the face of the roller being provided with an outer coating of a hard metal thereon.

2. The roller according to claim 1, wherein said flanges are forged members, said flanges and said cylindrical body are made of steel, said corrosion-resistant metal is nickel, said metal of good electrical conductivity is copper, and said hard metal is chromium.

* * * * *